United States Patent [19]

Yamauchi

[11] 4,206,514

[45] Jun. 10, 1980

[54] SANITARY FOOTGEAR ARTICLES

[76] Inventor: Akira Yamauchi, 13-7, Minami Mukonoso 5-chome, Amagasaki, Japan

[21] Appl. No.: 811,979

[22] Filed: Jun. 27, 1977

[30] Foreign Application Priority Data

Jun. 23, 1976 [JP] Japan ..... 51-74764

[51] Int. Cl.[2] ..... A41B 11/00

[52] U.S. Cl. ..... 2/239; 2/409; 424/65; 428/328

[58] Field of Search ..... 2/239, 240, 409, 53; 36/43, 44, 98; 424/76, 125, 65; 428/328

[56] References Cited

U.S. PATENT DOCUMENTS

| | | | |
|---|---|---|---|
| 2,248,303 | 7/1941 | Morgenroth et al. | 2/239 |
| 3,842,519 | 10/1974 | Lapidus | 36/44 |
| 4,015,347 | 4/1977 | Morishita et al. | 36/44 |

FOREIGN PATENT DOCUMENTS

| | | | |
|---|---|---|---|
| 597663 | 5/1934 | Fed. Rep. of Germany | 2/239 |
| 2007860 | 9/1971 | Fed. Rep. of Germany | 2/239 |
| 1270809 | 4/1972 | United Kingdom | 2/53 |

*Primary Examiner*—H. Hampton Hunter

*Attorney, Agent, or Firm*—Armstrong, Nikaido, Marmelstein & Kubovcik

[57] ABSTRACT

A sanitary footgear article in the form of a sock or stocking having adhering to the inner sole portion a multiplicity of resinous spots having embedded therein fine particles of copper, silver or copper-silver alloy.

4 Claims, 2 Drawing Figures

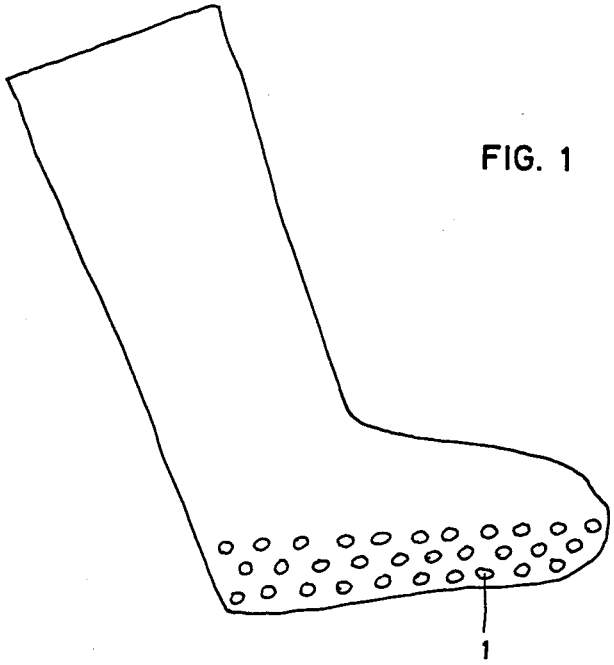
FIG. 1
FIG. 2
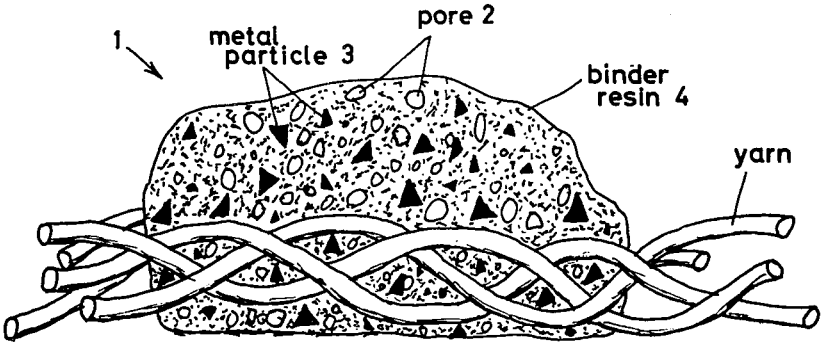

SANITARY FOOTGEAR ARTICLES

This invention relates to a sanitary footgear article and more particularly to a footgear article wherein a certain sanitary composition is applied to at least that portion which contacts the sole of a wearer.

In recent years, because of a longer living time we wear socks, stockings or the like and shoes and because of the fact that there is a tendency that these footwear articles are made of synthetic materials which are poor in air permeability and moisture permeability, many people have been suffering from stuffyness or mustyness of foot and also from water eczema or athelete's foot. For its remedy, various proposals have been made. Most typical one is to apply an antifungal medicinal preparation directly to the foot skin. However such is troublesome and most of the preparations of this kind are pasty or sticky causing uncomfortable feeling when applied. Another proposal is to impregnate socks, stockings or the like with various antifungal agents. It has been considered that such antifungal agents should be water-soluble ones which can develop the effect when contacted with moisture secreted from the wearer's foot. Therefore when such socks or stockings are washed the soluble antifungal agent is washed away so that it is difficult to retain the effect for a long time.

It has also been proposed to prepare extremely fine fibers of such metal as copper or silver and to blend the same with usual textile fibers from which socks, stockings or the like are made. In this case the metal would act as antifungal agent. However it is difficult to prepare such extremely fine metallic filaments and the production of socks, stockings or the like therefrom involves a number of technical difficulties, leading to high production cost. Further the use of such metallic fibers is disadvantageous because they are poor in blending properties in comparison with usual fibers and they are stiff or not sufficiently flexible so that when repeatedly used they break into fine fragments and come off.

It is in object of this invention to provide a footgear article with sanitary, antifungal and antimicrobial effect which has excellent launtry-fastness and therefore can provide the effect for a long period of time even after repeated washing or laundering.

Other objects of this invention will apparent from the following detailed explanation.

BRIEF DESCRIPTION OF THE DRAWINGS

FIG. 1 is a diagram showing the sanitary footgear article of this invention, including porous spots of resin and metal adhering thereto; and FIG. 2 is a drawing of one of said porous spots showing said spot in magnified (or enlarged) form.

DESCRIPTION OF THE PREFERRED EMBODIMENTS

Briefly, according to this invention there is provided a footgear article wherein a sanitary composition 1 is applied and fixed to at least that portion which directly contacts with the sole of a wearer, said sanitary composition comprising finely divided metal 3 consisting of metallic copper, silver, copper-silver alloy or a mixture of them held by and dispersed in a substantially water-insoluble synthetic resin binder 4.

The term "footgear article" as herein used broadly means socks, stockings, panty stockings, shoe insoles and the like which have a portion to be directly contacted with the sole of a wearer's foot. However it is most preferable to embody this invention in socks and stockings (inclusive panty stockings) which are subjected to repeated washing.

The sanitary composition to be applied to footgear articles according to this invention must contain a finely divided metallic powder. The metal is selected from the group consisting of copper, silver, copper-silver alloy and mixture of two or more of them. The fine metal particle may have a thin oxide surface layer thereon. The metal powder should have particle size as fine as possible. Generally the metal powder has an average particle size of 10–60 microns. The amount of the metal powder is generally 50–150 parts by weight per 100 parts of the binder resin.

Another essential ingredient of the sanitary composition to be used in this invention as a substantially water-insoluble binder. As for the binder, any water-insoluble synthetic resin which is well known as a binder for textile printing ink or paste may be used in this invention. Examples of such resins are acrylic resins (e.g. acrylic esters, acrylic amides, acrylonitrile, etc.), epoxy resins, urethane resins, vinyl resins (e.g. vinyl acetate, ethylene-vinyl acetate copolymer, etc.).

In order to improve softness, air- and moisture-permeability of the sanitary composition on the surface of the footgear article according to this invention it is preferable that the composition be foamed to be porous i.e., having pores 2 therein. This can be effected by incorporating a proper foaming agent in the sanitary composition before applying to the footgear article, and after it is applied to the footgear article the composition is foamed by a heat treatment. A typical example of such foaming agent is Saran Microsphere (capsules of vinylidene chloride/acrylonitrile copolymer - trade mark of Dow Chemical, U.S.A.; also refer for example to U.S. Pat. No. 3,864,181) by the use of which foaming occurs when heated at a temperature of 100°–120° C. The foamed composition is also preferable because the surface area is increased so that its sanitary and antimicrobacterial or antifungal effect is more effectively developped.

If desired it is also possible to add a softening agent, plasticizer, pigment (e.g. carbon black, titanium oxide, diazo yellow, phthalocyanine blue, etc.), etc. to the antifungal composition to be used in this invention. Since these additives are well known in the art of textile printing inks or pastes, it would be not necessary to make a detailed explanation thereabout.

The footgear article (socks, stockings or the like) itself may be any conventional one so far as it has a portion to be contacted directly contacted with the sole of a wearer. The material therefor may be any conventional one such as cotton, wool, silk, hemp, nylon, polyester, polyacrylonitrile, viscose rayon, vinylon, etc.

In applying a sanitary composition to a footgear article any suitable manner may be used. However, generally, the sanitary composition is first prepared in the form of a printing ink or paste, which is then applied to the foot-gear article by a suitable manner such as screen printing or roller printing.

Usually the printing ink or paste is prepared as an aqueous type. Thus the aqueous printing ink or paste comprises a metal powder and resin (usually prepolymer or precondensate) and water. If desired a foaming agent (usually in the amount of 50–100 parts by weight per 100 parts of the resin) and other additives such as pigment, thickener, antifoaming agent (to prevent undesirable foaming of ink or paste before applying to footgear article), etc. When the resin requires a cross-linking agent, curing agent, catalyst, etc. for curing on the footgear article such agent is also added to the printing ink or paste. Such agents are of course determined depending upon the particular type of resins and are well known per se in the art of textile color printing.

The viscosity of the printing ink or paste may be varied over a wide range. However, generally, it has a viscosity of 5,000 to 10,000 centipoises.

More typical method for applying such printing ink or paste to a footgear article is by means of screen printing, roller printing, spraying or the like which is well known in the art of printing on textiles. Thus, for example, in case of sock or stocking it is turned inside out to expose the sole portion thereof to be directly contacted with the wearer's sole, and the printing ink or paste is applied onto the surface of said exposed portion. When the ink or paste is applied to the entire surface of said sole portion, the fabric becomes stiff causing uncomfortable feel and further the air- or moisture-permeability is impaired. Therefore it is preferable to apply the ink or paste in a spaced-apart relation such as in the form of dots, stripes, crosses and the like. It is also preferable that such dots, stripes or the like are arranged so as to be higher in density at the toe portion than the remainder. In such case it is preferable that the area coated with the ink or paste be about 30–70% of the total area of the sole. In case of insoles, sandals or the like the printing ink or paste may be directly applied on the surface in the same manner as above. After the application, the article is heat-treated so that water is evaporated and the resin is set and fixed firmly on the surface of the footgear article. When the composition contains a foaming agent, the resin binder will be foamed when heat treated so that its softness and moisture absorpability will be improved. Further the surface area of the sanitary composition on the footgear article is increased so that the sanitary, antifungal and antimicrobial effects are increased.

The temperature for the heat-treatment may vary depending mainly upon the particular resin used. However, generally, the heat-treatment is conducted at a temperature of from 100°–150° C. for 30 sec. to 10 minutes.

After the application of the ink or paste and subsequent heat treatment, there remains a solid sanitary composition on the surface of the footgear article. The solid sanitary composition is firmly held by the fibrous material of the footgear article but most of the solid mass takes the form of raised portions on the surface of the footgear article. In the solid mass of the sanitary composition the fine metal particles are dispersed in and held by the binder resin. When a foaming agent is used as explained before the solid mass of the sanitary composition is porous.

As is well known, when socks, stockings or the like are worn, sweat, fats, etc. are secreted from the wearer's sole skin and such secretion substances are decomposed to cause unpleasant smell and stuffyness or mustyness of foot. Further such secretion substances will promote the growth of bacteria and fungi causing water eczema or athelete's foot.

The sanitary footgear article according to this invention is to overcome these troubles and disadvantages. Thus when the footgear article is worn the sole skin of the wearer's foot will contact the solid sanitary composition deposited on the surface of the footgear article. Due to friction, the metal particles will be gradually released from the binder resin. Meanwhile, during the wearing of the footgear article, sweat, fat and the like are secreted from the wearer's foot skin. Although the exact working mechanism by which the surprising effect of the footgear article according to this invention is developed is not fully known, it is believed that the effect is caused through the following mechanism. Thus, the above mentioned secretion substances (sweat, fat and the like) will be subjected to certain chemical reaction such as oxidation to produce acidic substances (most probably some fatty acids), which would chemically combine with the metal released from the resin binder so that the metal is chemically converted (most probably to salts) to soluble one and ionized. As is known metal ions have an astringent action against sweat-glands and skin-fat-glands so that the further secretion of sweat, fat and the like is prevented. Even if a small amount of such substances is secreted the growth of microorganisms thereon is prevented because such metal ions have antimicrobial and antifungal activity. The results are that when the footgear article of this invention is worn, unpleasant smell and stuffyness or mustyness do not occur and further water eczema or athelete's foot is prevented and cured.

Since the metal powder is insoluble in water and is held within the water-insoluble resin binder, it is not washed away by usual and repeated laundering. When the footgear article is worn, the metal particles come out or are released from the resin binder due to the friction of the solid mass of the sanitary composition with the wearer's sole skin. Therefore the desired effect is maintained for a long time.

The invention will be explained more concretely by referring to the following Examples wherein all parts are by weight.

EXAMPLE 1

25 parts of 99% purity copper powder (electrolytic copper, average particle size about 50μ) and 1 part of carbon black were added to 100 parts of a base binder of the following formulation:

| | |
|---|---|
| Polyvinyl acetate emulsion (resin content 60%) | 60 parts |
| Saran Microsphere (foaming agent of Dow Chemical) | 30 parts |
| Ethylene glycol | 5 parts |
| Antifoam DNE (antifoaming agent of Bayer) | 0.1 part |

The mixture was well agitated while adding water to prepare a printing ink having a viscosity of 8,000 cps.

A sock of nylon-cotton blended fibers was turned inside out to expose the sole surface (which is to be directly contacted with the sole of a wearer) and was flattened by inserting a support plate into the sock. The above prepared printing ink was printed through a silk screen on said sole surface in the form of spaced-apart dots, each in the shape of an oval having a long diameter of about 2 mm. and a short diameter of about 1 mm. The thickness was about 0.2 mm. The total area of the dots was about 50% of the total area of said sole surface.

Then heat-treatment was conducted by hot air at 120° C. for one minute to foam and fix the resin.

For evaluating the sanitary effect of the thus prepared socks, actual wear tests were conducted with 15 patients suffering from water eczema in both feet. Each patient wore the a treated sock and a non-treated sock on the right foot and left foot respectively. Every day, after a whole day of wearing, the socks were washed and the same socks were worn next day in the same manner and again washed. This was continued for 3 months. The results in respect of the feet on which the treated socks of this invention were worn are as follows:

| | One week | One month | Three months |
|---|---|---|---|
| Bad smell | Diminished | Diminished | Diminished |
| Itch | Less | Less | Relieved |
| Skin blister | Somewhat diminished | Considerably diminished | Completely diminished |

After three months, 11 patients were completely healed, 3 patients considerably healed and 1 not healed. For the left feet on which the same but non-treated socks were worn all patients had unpleasant bad smell and itchy feeling every day and no improvement in the condition of water eczema was observed in three months.

EXAMPLE 2

A textile printing ink was prepared in accordance with the following composition:

| | |
|---|---|
| Vinyl acetate/ethyl acrylate copolymer emulsion (solid content 30%) | 60 parts |
| Ethylene glycol | 8 parts |
| Antifoam DNE | 0.2 part |
| Copper powder/silver powder mixture (9/1), average particle size 50μ | 25 parts |
| Water | 6.8 parts |

The above mixture was well mixed and agitated while adding water to adjust the viscosity to about 7500 cps.

The prepared printing ink was screen-printed on a sock of nylon-cotton (30/70) in the same manner as in Example 1 except that the printing pattern was in the form of spaced-apart stripes which extend longitudinally from the heel end to the toe top of the sole. The width of each stripe was 1.5 mm. and the interval between adjacent stripes was 1.5 mm. The thickness of the ink as applied was about 0.2 mm. The heat-treatment was conducted at 110° C. for 1 minute.

In respect of the thus produced sanitary socks, actual wear test was conducted in the same manner as in Example 1 with 30 water eczema patients. The results were similar to those of Example 1. Thus after three months 21 patients were completely healed from water eczema, 7 patients considerably healed and 2 patients not healed.

EXAMPLE 3

A textile printing ink was prepared in accordance with the following composition:

| | |
|---|---|
| Aqueous emulsion of methyl acrylate/ethyl acrylate/2-ethylhexyl acrylate copolymer modified by N-methylol acrylamide | 100 parts |
| Sumitex ACX (catalyst for thermosetting acrylic resin, Sumitomo Chemical Co., Ltd.) | 0.5 part |
| Electrolytic copper powder (about 50μ) | 25 parts |

The above mixture was agitated while dropwise adding 28% aqueous ammonia to adjust the viscosity to about 8,000 cps.

By the use of this printing ink a nylon/cotton sock was printed in the same manner as in Example 1 and heat-treatment (baking) was conducted at 140° C. for 5 minutes.

In respect of the thus prepared sanitary socks, actual wear test was conducted in the same manner as in Example 1 with 35 eczema patients. The results were similar to those of Example 1. Thus after three months, 16 patients were completely healed from water eczema, 12 patients considerably healed and 7 patients not healed. However, even in case water eczema was not sufficiently healed, the patients had no unpleasant bad smell and they did not suffer from unpleasant stuffyness or mustyness of feet on which the sanitary socks of this invention were worn.

What is claimed is:

1. A sanitary footgear article of the sock, stocking or panty stocking type which has deposited on and adhering to the surface of the portion to be contacted directly with the sole of a wearer porous spots of a solid sanitary composition comprising a water-insoluble resin binder and a metal powder dispersed in and held by said resin binder, said metal being selected from the group consisting of copper, silver, copper-silver alloy and mixture thereof.

2. A sanitary footgear article according to claim 1 wherein the metal powder has an average particle diameter of 10–60 microns.

3. A sanitary footgear article according to claim 1 wherein the metal powder is used in an amount of 50–150 parts by weight per 100 parts of the resin binder.

4. A sanitary footgear article of the sock, stocking or panty stocking type having antifungal and antimicrobial effects which has deposited on and adhering to the surface of the portion to be contacted directly with the sole of a wearer, porous spots of a solid sanitary composition comprising a water-insoluble resin binder and 50–150 parts by weight of a metal powder per 100 parts of said resin binder, said metal powder having an average particle diameter of 10–60 microns, dispersed in and held by said resin binder, said metal being selected from the group consisting of copper, silver, copper-silver alloy and mixtures thereof.

* * * * *